US008651232B2

(12) United States Patent
Kedar et al.

(10) Patent No.: US 8,651,232 B2
(45) Date of Patent: Feb. 18, 2014

(54) REINFORCED ACRYLIC GLASS PANELS

(75) Inventors: Ehud Kedar, Ramat Yishai (IL); Joaquin Aliu Agullo, Sant Julia de Ramis (ES); Mariona Mata Molinet, Girona (ES)

(73) Assignee: Plazit Iberica Plastic Solutions, S.A. (ES)

( * ) Notice: Subject to any disclaimer, the term of this patent is extended or adjusted under 35 U.S.C. 154(b) by 0 days.

(21) Appl. No.: 13/823,548

(22) PCT Filed: Sep. 21, 2011

(86) PCT No.: PCT/IL2011/000750

§ 371 (c)(1), (2), (4) Date: Mar. 14, 2013

(87) PCT Pub. No.: WO2012/038961

PCT Pub. Date: Mar. 29, 2012

(65) Prior Publication Data

US 2013/0175116 A1 Jul. 11, 2013

Related U.S. Application Data

(60) Provisional application No. 61/384,718, filed on Sep. 21, 2010.

(51) Int. Cl.

| | |
|---|---|
| ***E04B 9/32*** | (2006.01) |
| ***E04H 17/14*** | (2006.01) |
| ***G10K 11/165*** | (2006.01) |
| *E04H 17/00* | (2006.01) |
| *G10K 11/16* | (2006.01) |

(52) U.S. Cl.
USPC ..... 181/289; 181/210

(58) Field of Classification Search
USPC ..... 181/294, 289, 210, 285; 256/13.1
See application file for complete search history.

(56) References Cited

U.S. PATENT DOCUMENTS

| | | | | | |
|---|---|---|---|---|---|
| 524,936 | A | * | 8/1894 | Croskey et al. | 428/38 |
| 533,512 | A | * | 2/1895 | Walsh, Jr. | 442/18 |
| 548,520 | A | * | 10/1895 | Croskey et al. | 428/38 |
| 1,837,455 | A | * | 12/1931 | Lewis | 428/38 |
| 2,659,686 | A | * | 11/1953 | Watkins | 52/208 |
| 4,029,037 | A | * | 6/1977 | Hogan | 114/127 |
| 5,040,352 | A | * | 8/1991 | Oberlander et al. | 52/786.11 |
| 5,160,782 | A | * | 11/1992 | Hickman | 442/18 |

(Continued)

FOREIGN PATENT DOCUMENTS

| | | | | | |
|---|---|---|---|---|---|
| EP | 531982 | A1 | * | 3/1993 | E01F 8/00 |
| EP | 559075 | A2 | * | 9/1993 | E01F 8/00 |
| JP | 03051406 | A | * | 3/1991 | E01F 8/00 |

*Primary Examiner* — Edgardo San Martin
(74) *Attorney, Agent, or Firm* — Fleit Gibbons Gutman Bongini & Bianco PL; Marty Fleit; Paul D. Bianco

(57) ABSTRACT

Transparent panel of acrylic glass (PMMA) having internal reinforcement elements for securing fragments of the acrylic glass formed upon an impact with a foreign body. The reinforcement elements are embedded interspersed within the panel and spaced apart in parallel longitudinally. The reinforcement elements include rigid cables and elastic cables. The rigid cables are formed of a metal having an ultimate tensile strength of at least 500 MPa. The elastic cables are formed of a metal having a percentage elongation (engineering strain at fracture) of at least 30%, preferably between 40% and 80%. The rigid cables and elastic cables may be separate and spaced apart from one another, or intertwined with each other. The panels may be used to form an acoustic barrier.

20 Claims, 7 Drawing Sheets

(56) References Cited

U.S. PATENT DOCUMENTS

| | | | | |
|---|---|---|---|---|
| 5,372,866 | A * | 12/1994 | Oberlander et al. | 428/110 |
| 5,794,403 | A * | 8/1998 | Oberlander et al. | 52/786.11 |
| 5,916,676 | A * | 6/1999 | Stasi | 428/364 |
| 6,305,492 | B1 * | 10/2001 | Oleiko et al. | 181/210 |
| 6,412,597 | B1 * | 7/2002 | Schola et al. | 181/290 |
| 6,641,903 | B2 * | 11/2003 | Schoela et al. | 428/293.4 |
| 7,090,906 | B2 * | 8/2006 | O'Keeffe | 428/38 |
| 7,220,077 | B2 * | 5/2007 | Humphries et al. | 404/6 |
| 7,665,574 | B2 * | 2/2010 | Schoela et al. | 181/210 |
| 8,003,199 | B2 * | 8/2011 | Schoela et al. | 428/212 |
| 2003/0008126 | A1 * | 1/2003 | Boesman et al. | 428/300.7 |

* cited by examiner

REINFORCED ACRYLIC GLASS PANELS

FIELD OF THE DISCLOSED TECHNIQUE

The disclosed technique generally relates to transparent panels based on acrylic polymers.

BACKGROUND OF THE DISCLOSED TECHNIQUE

Panels or sheets made of polymethyl-methacrylate (PMMA), also known as acrylic glass, are commonly used in acoustic barriers due to their transparency, weather resistance, and noise abatement properties. Such acoustic barriers are regularly installed along roadways, thoroughfares, and railway lines exposed to heavy motor vehicle traffic, in order to mitigate the resultant noise. However, if one of these panels is subject to a forceful impact, such as by being struck by an oncoming vehicle, the panel may shatter into multiple fragments, which may then fall onto the adjacent roadway in a hazardous manner. Accordingly, it is known to embed various forms of wires, cables or nets within the panel, which serve to contain any loose fragments formed upon impact. These embedded elements are typically made from a plastic material, such as monofilament polymer fibers. Ideally, the embedded elements also provide the panel with certain desirable properties, or maintain such properties that are already present in the panel, including: transparency, strength, ability to withstand inclement weather conditions, environmental friendliness, low cost, and ease of manufacture.

U.S. Pat. No. 4,029,037 to Hogan, entitled "Process for reinforcing plastic material and products therefrom", is directed to a foamed plastic material with high tensile steel reinforcing elements, particularly suitable for the manufacture of sailing boat components. The high tensile steel elements are surface etched to each of the opposing surfaces of the foamed plastic core. The high tensile steel elements are preferably formed as wires, spaced in parallel, with a diameter of about 0.040 to 0.125 inches, having a yield strength of at least 200,000 psi, and located at a depth of at least 0.06 inches from the outermost surface.

U.S. Pat. No. 5,040,352 to Oberländer et al, entitled "Noise-protection elements of acrylic glass", is directed to transparent acrylic panels for use as a sound barrier. The panel contains plastic threads, plastic bands or a plastic net, embedded approximately midway between the spaced parallel faces of the panel. The embedded threads or bands are arranged to run parallel to each other in one direction, or alternatively, in two perpendicular directions. If the acrylic glass breaks, the threads or bands expand and hold together the resulting fragments. The threads or bands are preferably monofilaments of polyamide or polypropylene, due to their low adhesion with acrylic glass.

U.S. Pat. No. 5,160,782 to Hickman, entitled "Wired glass", is directed to glass formed with an embedded wire mesh, that acts as a reinforcement when the glass is struck or exposed to intense heat. The glass is made up of two spaced apart glazing panels, bonded together with an interlayer of adhesive material in which the wire mesh is embedded. The wires consist of a metallic core and an outer decorative coating that is colored, to provide the wires with a desired visual appearance.

U.S. Pat. No. 5,372,866 to Oberländer et al, entitled "Transparent plastic panels having bird protection, and use thereof as sound barriers", is directed to transparent plastic panels suitable for noise barriers and which is intended to protect birds without disturbing the environment. The panels include embedded monofilament plastic fibers, to reduce fracturing or prevent fragmentation during breakage. The plastic fibers are formed with a high-contrast (i.e., having a low transmission ratio and different color from the background), such as using a black-dyed polyamide, enabling birds to recognize the transparent wall and avoid flying into it.

European Patent No. 0,559,075 to Müller, entitled "An appropriate noise protection element plate of acrylic glass", is directed to an acrylic glass plate with embedded reinforcing strands for securing loose fragments in the plate surface. The strands are in the form of steel wire spirals, having a diameter less than the plate thickness, and arranged in parallel to one another. The interior of the steel wire spirals are either hollow or filled with a deformable medium.

U.S. Pat. No. 5,916,676 to Stasi, entitled "Antifragmentation plates based on acrylic polymers", is directed to acrylic polymer plates to be used as barriers having anti-noise and anti-fragmentation properties. The plates contain a series of filaments of plastic material, positioned asymmetrically at a distance of between 20% and 35% of the total thickness of the plate, with respect to the surface opposite the surface subject to impact. The filaments preferably include monofilaments such as polyamide and polypropylene.

U.S. Pat. No. 6,641,903 to Schoela et al, entitled "Transparent plastic pane of acrylic glass, process for making the same and use of the same", is directed to transparent plastic panes of acrylic glass suitable for noise protection walls and intended to not produce any splinters or loose fragments if the pane breaks. The pane includes internal plastic filaments embedded in the acrylic glass. The plastic filaments are made of monofilaments, such as polyamide or polypropylene. The plastic filaments are sized over a specified length (about 2 to 10 cm) at specified intervals (about 0.5 to 1.5 m). The sized filaments are at least partially coated with the residues of a sizing agent, which preferably contains a dissolved phenol-formaldehyde resin.

European Patent No. 1,936,035 to Japelj et al, entitled "Panels with antinoise and antifragmentation properties on the basis of acrylic glass, process for their preparation and use thereof", is directed to acrylic glass (PMMA) panels suitable as antinoise elements for sound barriers on highways, bridges, viaducts, and the like. Reinforcing polymer monofilament fibers are embedded into the PMMA matrix in the form of a three-dimensional fiber entanglement. The fibers are oriented in all directions and distributed apparently uniformly in all directions. The polymer monofilament fibers may be polyethylene, polycarbonate, polyamide or polypropylene fibers, previously formed into a three-dimensional fiber entanglement that can retain its shape throughout a long period of time.

U.S. Pat. No. 7,665,574 to Schoela et al, entitled "Soundproofing restraining system", discloses a sound deadening retention system made up of a transparent acrylic sheet with at least one embedded metal wire. A synthetic polymer layer is present between the surface of the metal wire and the transparent acrylic matrix, such that at least ninety percent of the metal wire surface is covered by the synthetic polymer layer. The polymer covered metal wires are preferably positioned with a degree of sag within the acrylic matrix, where the deviation is substantially perpendicular or substantially parallel to the sheet plane. The acrylic sheet may also include embedded synthetic polymer filaments for improving splinter retention. The retaining system may be used as a noise barrier on a bridge or multi-storey car park, where the puncturing of the barrier upon impact is prevented.

SUMMARY OF THE DISCLOSED TECHNIQUE

In accordance with one aspect of the disclosed technique, there is thus provided a transparent panel of acrylic glass having internal reinforcement elements for securing fragments of the acrylic glass formed upon an impact with a foreign body. The reinforcement elements are embedded interspersed within the panel and spaced apart in parallel longitudinally. The reinforcement elements include rigid cables and elastic cables. The rigid cables are formed of a metal having an ultimate tensile strength (UTS) of at least 500 MPa. The elastic cables are formed of a metal having a percentage elongation (engineering strain at fracture) of at least 30%, and preferably between 40% and 80%. The rigid cables and elastic cables may be separate and spaced apart from one another, or they may be intertwined with each other. The reinforcement elements may be aligned horizontally, vertically, diagonally, or in a grid pattern, with respect to the length or width of the panel. The rigid cables may alternate individually with the elastic cables, or there may be multiple rigid cables or multiple elastic cables grouped together. The panel or reinforcement elements may be tinted with a selected color to provide a desired visual appearance. The panels may form part of an acoustic barrier installed along a roadway.

In accordance with another aspect of the disclosed technique, there is thus provided a method for manufacturing a transparent panel of acrylic glass having internal reinforcement elements for securing fragments of the acrylic glass formed upon an impact with a foreign body. The method includes the procedures of fabricating an acrylic glass sheet, and embedding a plurality of reinforcement elements interspersed within the sheet and spaced apart in parallel longitudinally. The reinforcement elements include rigid cables and elastic cables. The rigid cables are formed of a metal having an ultimate tensile strength (UTS) of at least 500 MPa. The elastic cables are formed of a metal having a percentage elongation (engineering strain at fracture) of at least 30%, and preferably between 40% and 80%. The panels may be manufactured using a casting process, an extrusion process, or separate fabrication of the sheets and subsequent adhesion or fusion together with the reinforcement elements. Computerized mechanical analysis may assist with various aspects of the overall design process, prior to or during the fabrication.

BRIEF DESCRIPTION OF THE DRAWINGS

The disclosed technique will be understood and appreciated more fully from the following detailed description taken in conjunction with the drawings in which.

DETAILED DESCRIPTION OF THE EMBODIMENTS

The disclosed technique overcomes the disadvantages of the prior art by providing an acrylic glass panel that is reinforced to securely withstand an impact or collision, and is thus suitable for use in an acoustic barrier. The panel includes two types of reinforcement elements, rigid metal cables and elastic metal cables, which are embedded interspersed within the acrylic glass. The combination of both rigid cables and elastic cables enables the panel to effectively absorb the kinetic energy resulting from an impact while preventing large fragments or debris from falling out in a dangerous manner. Different configurations of the embedded cables within the panel will result in different performances under impact conditions. The design of the composite panel may be aided by computerized mechanical analysis.

Figure 1A:
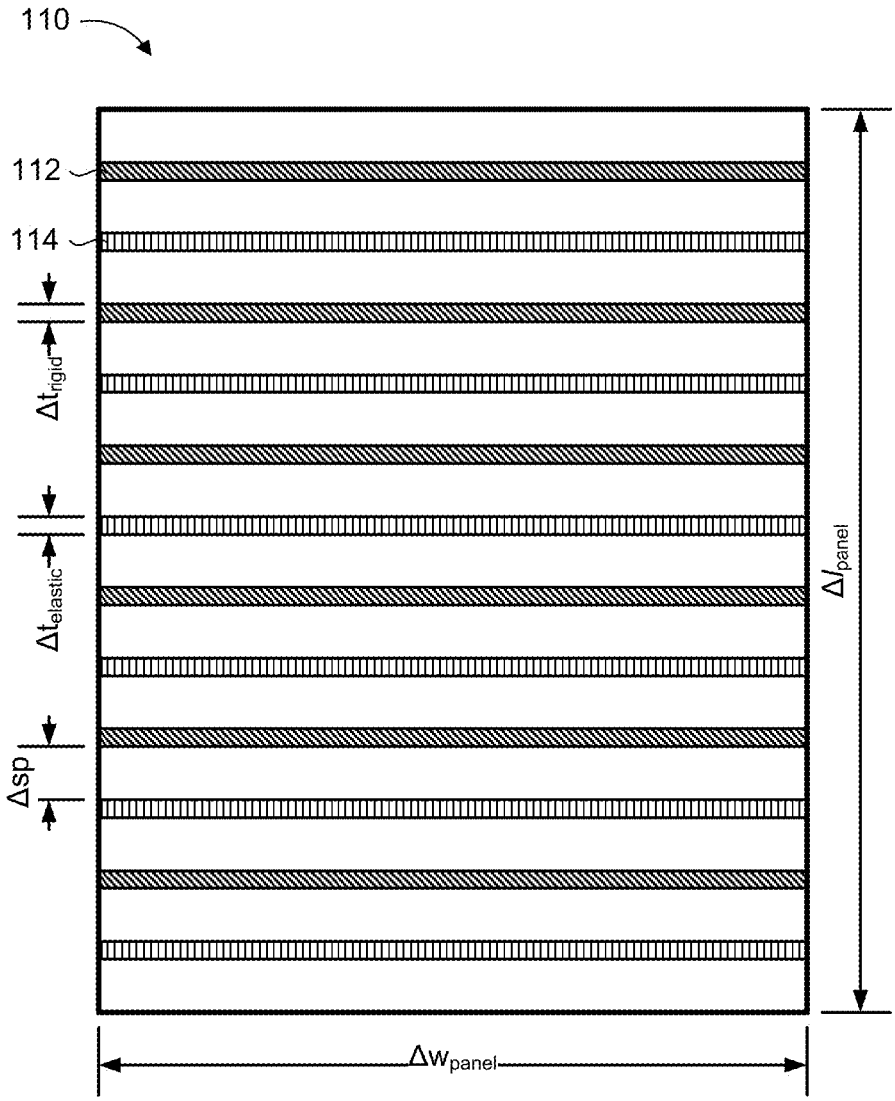
FIG. 1A is a front view cross section illustration of a reinforced acrylic glass panel, constructed and operative in accordance with an embodiment of the disclosed technique.
Figure 1B:
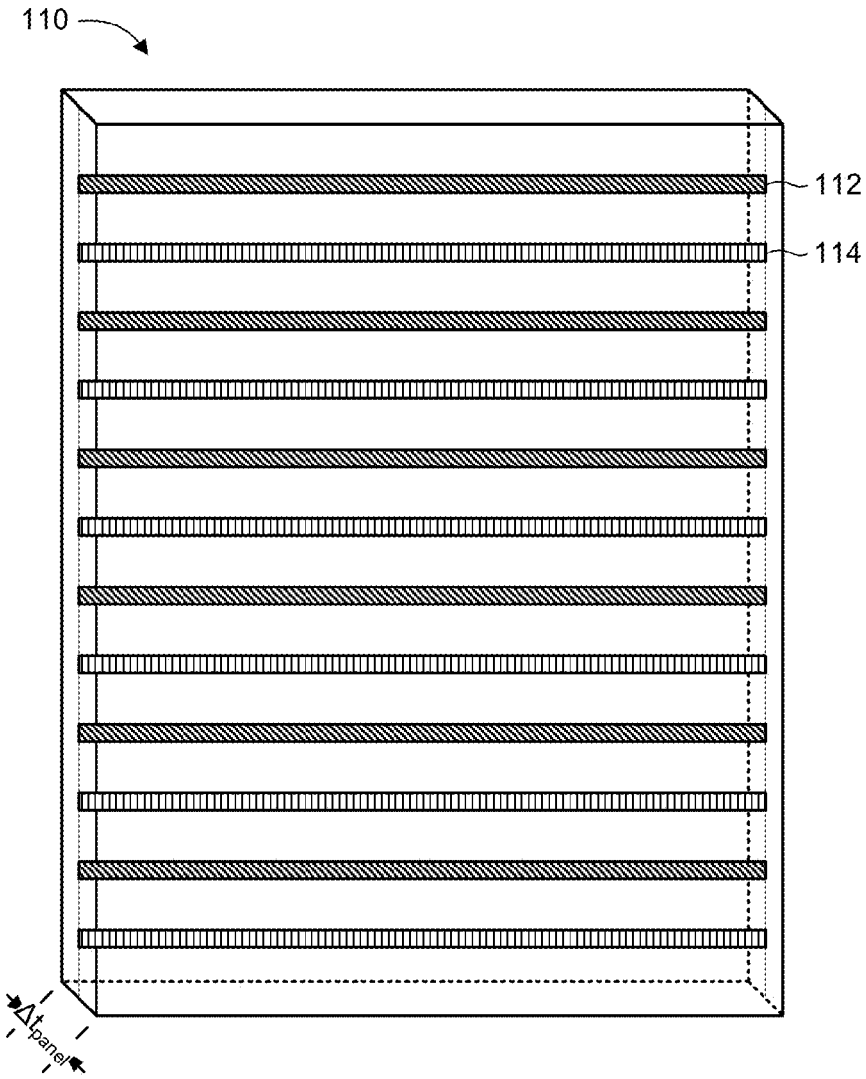
FIG. 1B is a perspective view cross section illustration of the reinforced acrylic glass panel of FIG. 1A.
Figure 1C:
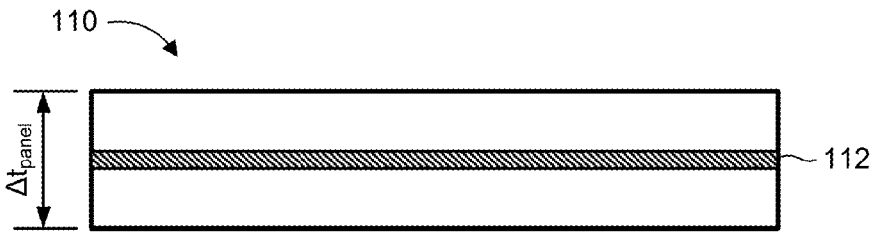
FIG. 1C is a top view cross section illustration of the reinforced acrylic glass panel of FIG. 1A.

Reference is now made to FIGS. 1A, 1B and 1C. FIG. 1A is a front view cross section illustration of a reinforced acrylic glass panel, generally referenced 110, constructed and operative in accordance with an embodiment of the disclosed technique. FIG. 1B is a perspective view cross section illustration of the reinforced acrylic glass panel of FIG. 1A. FIG. 1C is a top view cross section illustration of the reinforced acrylic, glass panel of FIG. 1A. Panel 110 is made of polymethylmethacrylate (PMMA), also known as acrylic glass. Panel 110 includes a plurality of rigid cables 112 and a plurality of elastic cables 114 embedded therein. Rigid cables 112 and elastic cables 114 are arranged longitudinally in parallel to one another, such that rigid cables 112 are interspersed with elastic cables 114 throughout the length of panel 110. Each rigid cable 112 and each elastic cable 114 is substantially straight and extends along the entire width of panel 110. Alternatively, rigid cables 112 and elastic cables 114 may be arranged in parallel throughout the width of panel 110, such that each rigid cable 112 and elastic cable 114 extends along the length of panel 110. Further alternatively, rigid cables 112 and elastic cables 114 may extend only partially along the length or width of panel 110, or may extend beyond the length or width of panel 110.

The term "cable" as used herein, as well as grammatical variations thereof, refers to any number of metal wires, including a single strand of wire or a bundle of multiple wire strands that are bound together, in any suitable configuration.

The thickness of panel 110 ($\Delta t_{panel}$) may be anywhere between 2 mm to 150 mm, although typically ranges from about 10 mm to 30 mm. The cross-sectional shape of rigid cable 112 or of elastic cable 114 is preferably circular, but may alternatively be a different shape, such as rectangular, square, and the like. The cross-sectional width (e.g., the diameter for circular cross-sectional cables) of each rigid cable 112 ($\Delta t_{rigid}$) and each elastic cable 114 ($\Delta t_{elastic}$) is between approximately 1 mm to 5 mm, and is preferably between 2 mm to 3 mm. All of the rigid cables 112 and elastic cables 114 within a given panel 110 are preferably of the same dimensions, although not necessarily. Rigid cables 112 and elastic cables 114 are preferably embedded substantially within the center with respect to the panel thickness ($\Delta t_{panel}$) to provide equal reinforcement for either surface (e.g., see FIG. 1C). The spacing between a rigid cable 112 and an elastic cable 114 ($\Delta sp$) is between approximately 1 cm to 15 cm, preferably between approximately 2 cm to 4 cm, and further preferably approximately 3 cm. Accordingly, for a panel 110 having dimensions of width ($\Delta w_{panel}$) 2 m and length ($\Delta l_{panel}$) 3 m (typical commercial dimensions), where the cable spacing ($\Delta sp$) is 3 cm, there would be a total of sixty-six (66) rigid cables 112 and elastic cables 114 (e.g., 33 rigid cables and 33 elastic cables). It is appreciated that panel 110 may alternatively have larger or smaller dimensions. Each rigid cable 112 and each elastic cable 114 is preferably substantially straight, such that there is no "sag" or deviation with respect to the plane of panel 110.

Rigid cables 112 are composed of a metal that has an ultimate tensile strength (UTS) greater than 500 MPa. Possible materials for rigid cables 112 include: steel, stainless steel, hardened steel, galvanized steel, iron, a metal alloy, a metal that has been treated to improve its rigidity (e.g., bimetal layers), and the like.

Elastic cables 114 are composed of a metal that has a percentage elongation (engineering strain at fracture) greater than 30%, preferably between 40% to 80%. Possible materials for elastic cables 114 include: steel, stainless steel, galvanized steel, copper, brass, aluminum, bronze, iron, a metal alloy, a metal that has been treated to improve its elongation (e.g., bimetal layers), and the like.

Figure 2:
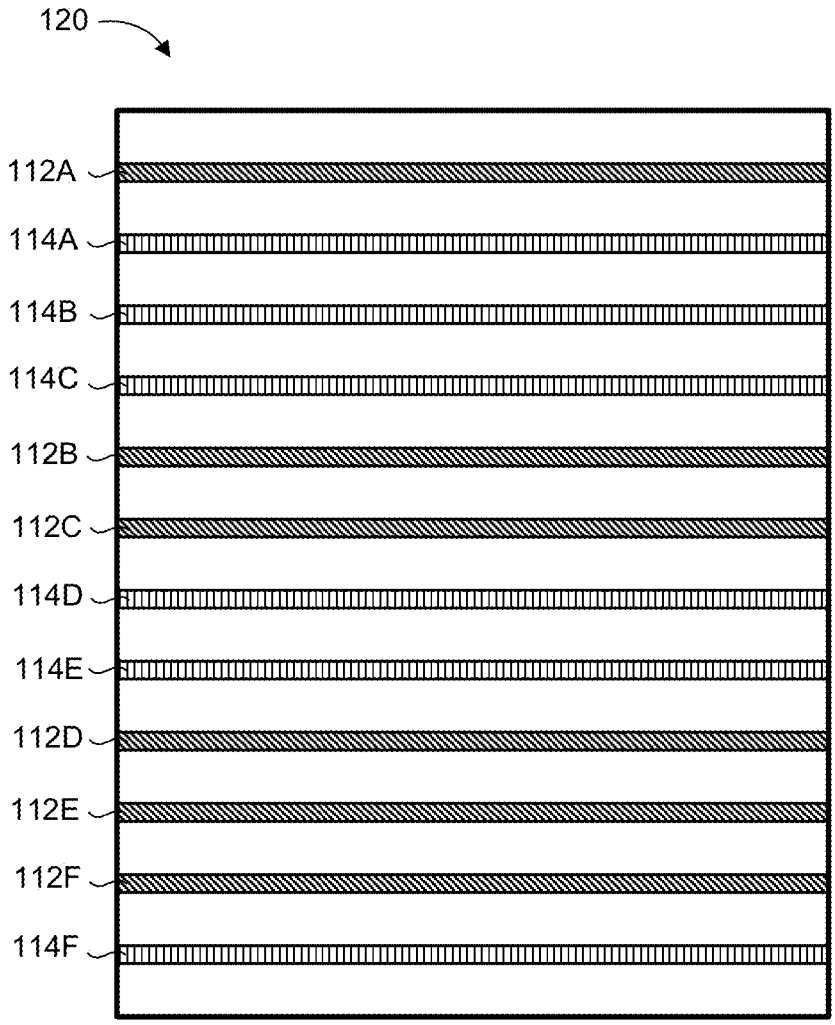
FIG. 2 is a front view cross section illustration of a reinforced acrylic glass panel with multiple rigid cables and multiple elastic cables grouped adjacently, constructed and operative in accordance with another embodiment of the disclosed technique.

Rigid cables 112 and elastic cables 114 may be interspersed in a variable manner, such that multiple elastic cables are embedded in between two rigid cables, or vice-versa. Reference is now made to FIG. 2, which is a front view cross section illustration of a reinforced acrylic glass panel, generally referenced 120, with multiple rigid cables and multiple elastic cables grouped adjacently, constructed and operative in accordance with another embodiment of the disclosed technique. In the exemplary panel 120 of FIG. 2, there are three elastic cables (114A, 114B, 114C) in between the uppermost rigid cable 112A and the second uppermost rigid cable 112B, while there are three rigid cables (112D, 112E, 112F) in between the second lowermost elastic cable 114E and the lowermost elastic cable 114F. It is appreciated that any configuration of multiple elastic cables 114 interspersed with multiple rigid cables 112 is within the scope of the disclosed technique.

Figure 3:
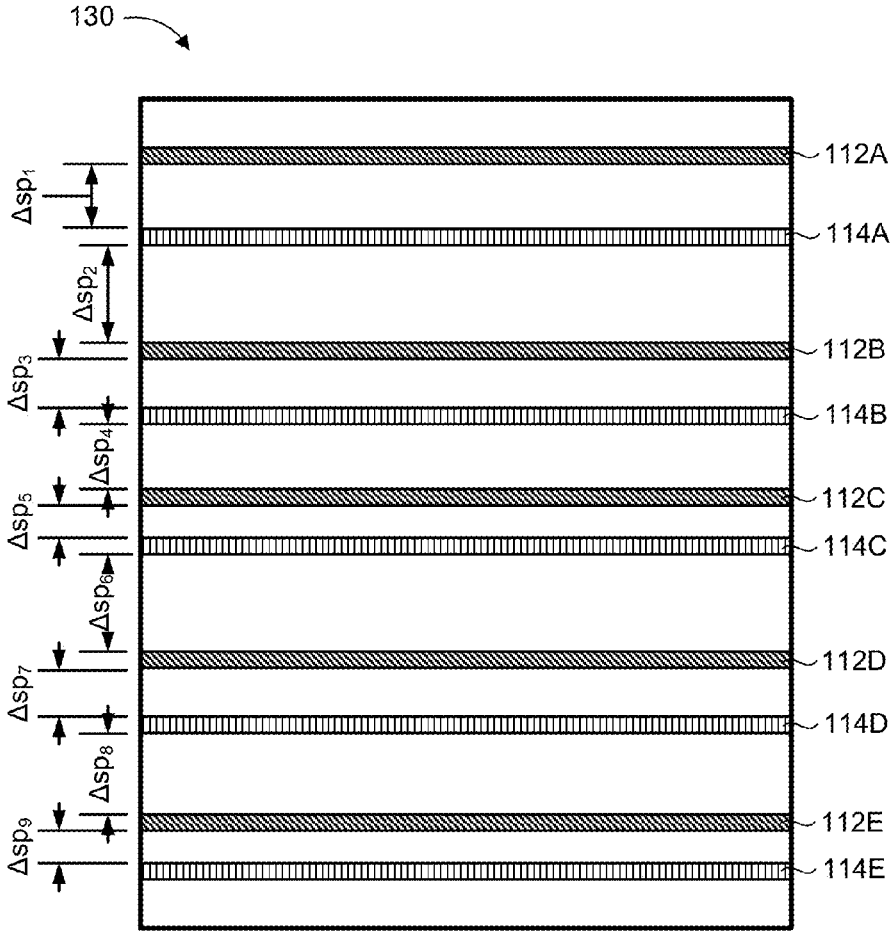
FIG. 3 is a front view cross section illustration of a reinforced acrylic glass panel with variable cable spacings, constructed and operative in accordance with a further embodiment of the disclosed technique.

The spacing between a rigid cable 112 and an elastic cable 114 ($\Delta sp$) may vary throughout the length (or width) of panel 110. Reference is now made to FIG. 3, which is a front view cross section illustration of a reinforced acrylic glass panel, generally referenced 130, with variable cable spacings, constructed and operative in accordance with a further embodiment of the disclosed technique. In the exemplary panel 130 of FIG. 3, there is a first spacing ($\Delta sp_1$) between the uppermost rigid cable 112A and the uppermost elastic cable 114A, which is smaller than the second spacing ($\Delta sp_2$) between the uppermost elastic cable 114A and the second uppermost rigid cable 112B. Similarly, the remaining respective spacings ($\Delta sp_3$, $\Delta sp_4$, $\Delta sp_5$, $\Delta sp_6$, $\Delta sp_7$, $\Delta sp_8$, $\Delta sp_9$) along the length of panel 110 are not necessarily of equal size. However, the rigid cables 112 and elastic cables 114 are preferably arranged in a substantially symmetrical fashion with respect to the spacings therebetween.

Figure 4:
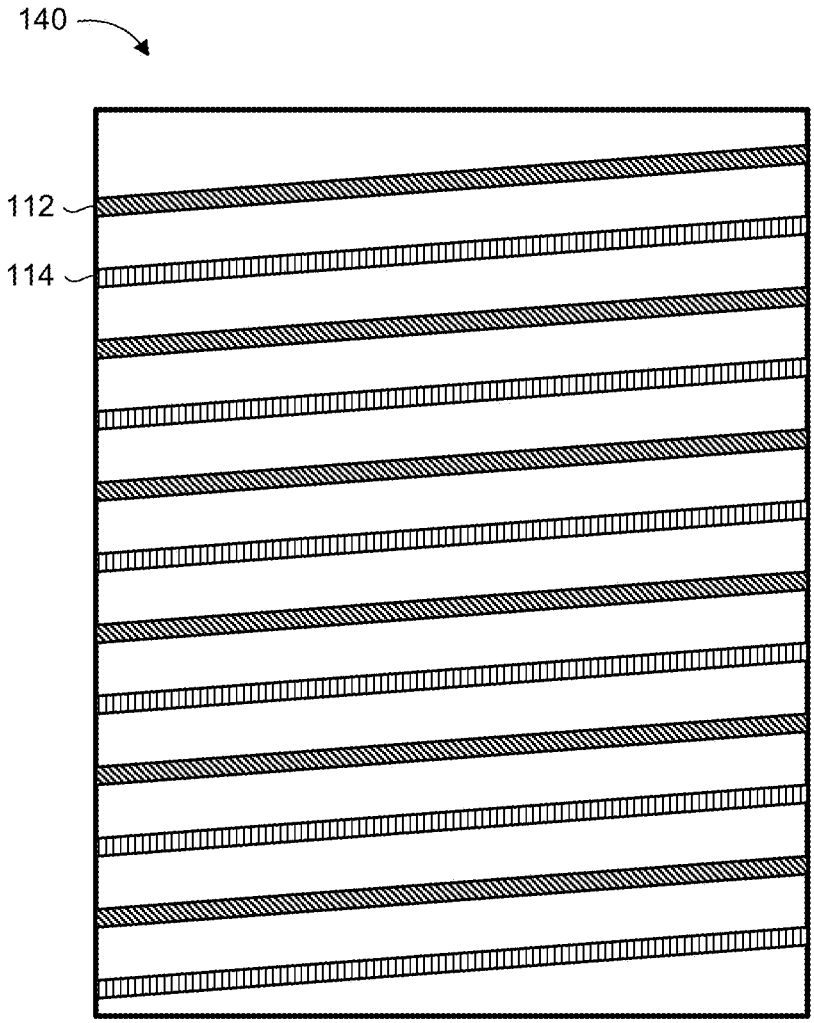
FIG. 4 is a front view cross section illustration of a reinforced acrylic glass panel with diagonally arranged rigid cables and elastic cables, constructed and operative in accordance with yet another embodiment of the disclosed technique.

Rigid cables 112 and elastic cables 114 may be aligned longitudinally parallel to the width or the length of the panel 110, or at an angle (i.e., diagonally) thereto. Reference is now made to FIG. 4, which is a front view cross section illustration of a reinforced acrylic glass panel, generally referenced 140, with diagonally arranged rigid cables and elastic cables, constructed and operative in accordance with yet another embodiment of the disclosed technique. In the exemplary panel 140 of FIG. 4, each rigid cable 112 is aligned at an angle with respect to the width and length of panel 140, where all rigid cables 112 remain longitudinally in parallel. Similarly, each elastic cable 114 is aligned at an angle with respect to the width and length of panel 140, where all elastic cables 114 remain longitudinally in parallel. It is appreciated that any alignment of rigid cables 112 and elastic cables 114 relative to one another, and relative to the panel, is within the scope of the disclosed technique.

Figure 5:
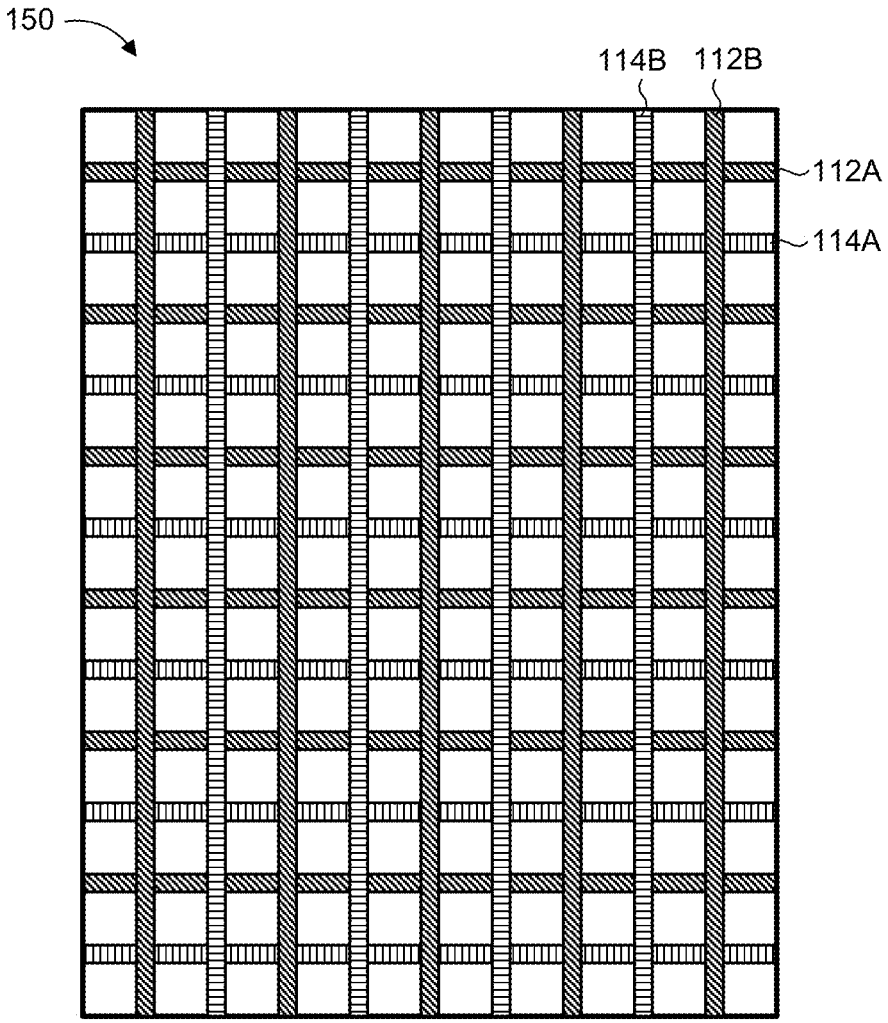
FIG. 5 is a front view cross section illustration of a reinforced acrylic glass panel with rigid cables and elastic cables arranged in a mesh pattern, constructed and operative in accordance with yet a further embodiment of the disclosed technique.

The panel 110 may also include rigid cables 112 and elastic cables 114 arranged both horizontally and vertically, forming a grid or a mesh pattern. Reference is now made to FIG. 5, which is a front view cross section illustration of a reinforced acrylic glass panel, generally referenced 150, with rigid cables and elastic cables arranged in a mesh pattern, constructed and operative in accordance with yet a further embodiment of the disclosed technique. In the exemplary panel 150 of FIG. 5, rigid cables 112 and elastic cables 114 are interspersed longitudinally in parallel along the length of panel 150, while additional rigid cables 112 and elastic cables 114 are interspersed longitudinally in parallel along the width of panel 150, thereby forming a mesh pattern. For example, the rigid cables 112 and elastic cables 114 arranged vertically are situated at a different thickness of panel 150 than the rigid cables 112 and elastic cables 114 arranged horizontally (i.e., each group is embedded at a different layer of panel 150). It is appreciated that the alignment or spacing of the vertical rigid cables 112 and elastic cables 114 may not necessarily be exactly the same as the alignment or spacing of the horizontal rigid cables 112 and elastic cables 114 in such a configuration, although they are preferably arranged in a substantially symmetrical fashion.

In accordance with yet another embodiment of the disclosed technique, rigid cables 112 and elastic cables 114 may be intertwined or interwoven with one another to form a single metal cable. Accordingly, panel 110 may include at least one reinforcement element composed of a combination of the rigid cable 112 material as described hereinabove (i.e., a metal having a UTS greater than 500 MPa) and of the elastic cable 114 material as described hereinabove (i.e., a metal having a percentage elongation greater than 30%, and preferably between 40% to 80%). For example, panel 110 includes multiple such reinforcement elements (that are composed of the combined materials) interlaced throughout panel 110 in a suitable configuration (such as any of the configurations depicted in FIG. 1A, FIG. 3, FIG. 4, or FIG. 5).

Figure 6:
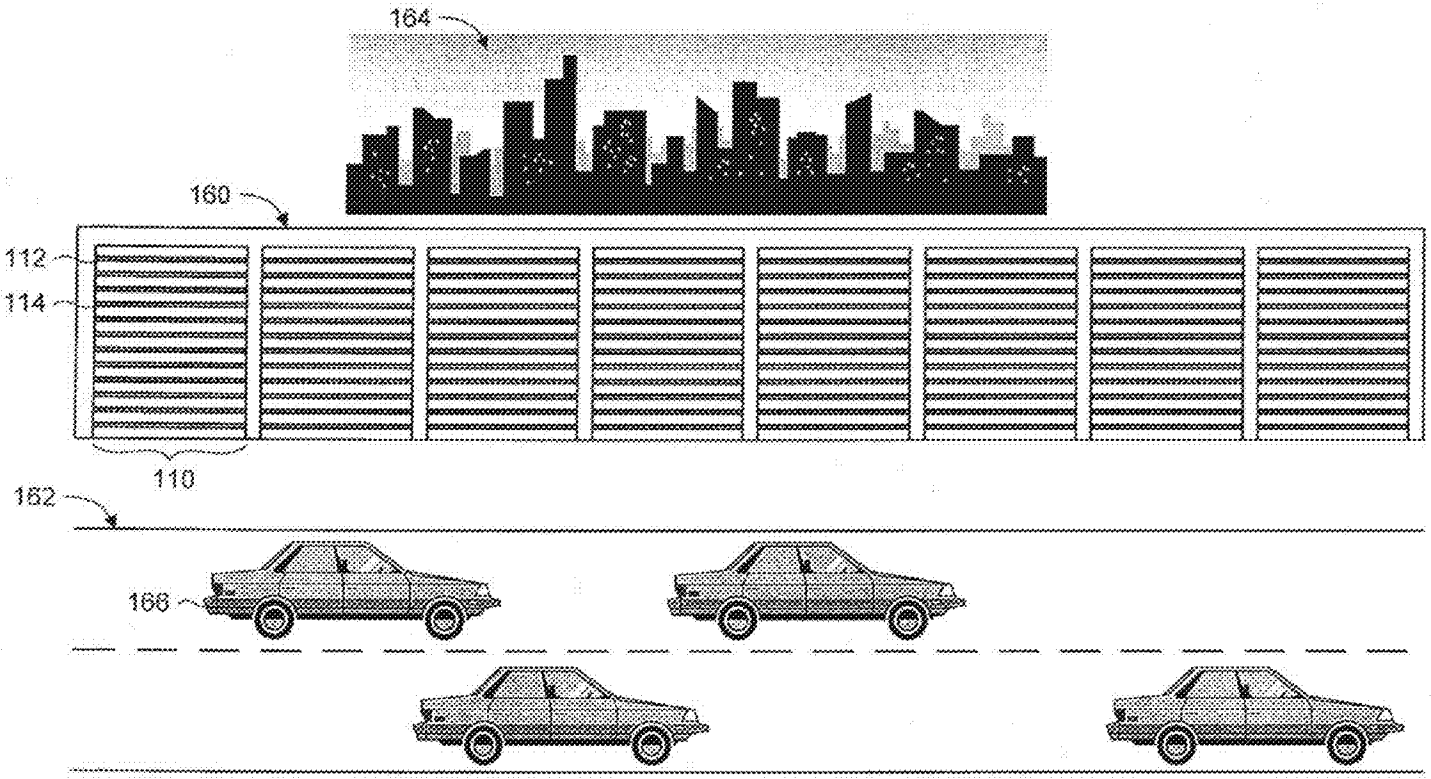
FIG. 6 is a schematic illustration of an acoustic barrier composed of multiple reinforced acrylic glass panels in accordance with an embodiment of the disclosed technique.

The reinforced panels of the disclosed technique may be used in various applications. For example, the panels may form part of an acoustic barrier that is installed along a roadway for reducing the noise emitted from the motor vehicles. The panels may alternatively be utilized in other general architectural arrangements. Reference is now made to FIG. 6, which is a schematic illustration of an acoustic barrier, generally referenced 160, composed of multiple reinforced acrylic glass panels in accordance with an embodiment of the disclosed technique. Acoustic barrier 160 is made up of multiple adjacent panels 110 linked to one another, where each panel 110 includes a plurality of rigid cables 112 and elastic cables 114 interspersed and longitudinally in parallel (e.g., as depicted in FIGS. 1A, 1B and 1C). As numerous automobiles 166 travel along road 162, acoustic barrier 160 serves to diminish the amount of noise caused by automobiles 166 which reaches the surrounding buildings 164.

If panel 110 is struck or otherwise subject to a forceful impact (e.g., due to a collision from an automobile 166), causing panel 110 to fracture into multiple fragments, the combination of rigid cables 112 and elastic cables 114 embedded within panel 110 serve to absorb the impact and restrain substantially large fragments from falling out onto road 162 and preventing a significant hazard to drivers, passengers or pedestrians in the general vicinity. In particular, the presence of rigid cables 112 provides sufficient flexural strength to absorb the kinetic energy resulting from a highly forceful impact, while the presence of elastic cables provides the ability to securely contain fragments or debris formed during the impact (i.e., if only rigid cables 112 were embedded in the panel then the fragments and debris would not be securely contained, whereas if only elastic cables were embedded in the panel then there would not be sufficient flexural strength to absorb the impact).

In this regard, panel 110 of the disclosed technique is in compliance with various official safety standard specification outlining requirements for the use of such panels as road traffic noise-reducing devices, such as European standard EN-1794-2 (Annex B). In an experimental test performed with an exemplary panel of the disclosed technique, the panel was able to withstand the impact from a pendulum weighing 400 kg and released from a height of 1.5 m that generated an impact force of 6 kJ, and prevented large fragments from falling out, thereby meeting the requirements outlined in EN-1794-2.

It is noted that the reinforcement elements (rigid cables 112 and elastic cables 114) maintain the panel 110 with a high degree of transparency, generally anywhere up to about 92% transmittance, while at the same time providing a sufficient visual contrast so that the panels are distinguishable by birds or other flying creatures in the vicinity, helping them to avoid from flying into the panel. Panel 110 and/or cables 112 or 114 may also be tinted with a selected color (e.g., via mass pigmentation or a color layer applied to an exterior or interior surface) to provide a desired visual appearance to the acoustic barrier (or an alternative structure formed from the panel), while still providing sufficient transparency or translucence (e.g., at least 6% transmittance). Additionally, the panel 110 is substantially durable and able to withstand inclement weather conditions (e.g., severe rain, snow, sleet, hail, prolonged exposure to sun and wind, and the like), while maintaining the visual contrast of the reinforcement cables.

The reinforced panels of the disclosed technique may be manufactured in different ways. Preferably, the panels are manufactured using a casting process, in which the acrylic glass is cast into moulds together with the rigid cables and elastic cables integrated with the acrylic glass, allowing curing to take place. Alternatively, an extrusion process may be implemented, where the acrylic glass sheets are formed via extrusion and the rigid cables and elastic cables are inserted through the dye at the appropriate positions while the acrylic glass material flows through in its plastic form. Further alternatively, two separate sheets of acrylic glass may be fabricated separately and then sandwiched together with the rigid cables and elastic cables suitably arranged in between, with the aid of an adhesive material, an adhesive interlayer, or by melted fusion of the interlayers. It is noted that the rigid cables 112 and elastic cables 114 are sufficiently stretched (undergo tension) during the manufacturing stage, to ensure that they are formed substantially straight. Computerized mechanical analysis may assist with various aspects of the overall design process, prior to or during the fabrication.

In accordance with the disclosed technique, a method for manufacturing a reinforced transparent acrylic glass panel includes, fabricating an acrylic glass sheet using a known fabrication technique, and embedding a plurality of reinforcement elements within the sheet and spaced apart in parallel longitudinally. The reinforcement elements include rigid cables formed of a metal having an ultimate tensile strength greater than 500 MPa, and further include elastic cables formed of a metal having a percentage elongation (engineering strain at fracture) greater than 30%.

It will be appreciated by persons skilled in the art that the disclosed technique is not limited to what has been particularly shown and described hereinabove.

The invention claimed is:

1. A transparent panel of acrylic glass, comprising internal reinforcement elements for securing fragments of said acrylic glass formed upon an impact with a foreign body, said reinforcement elements embedded interspersed within said panel and spaced apart in parallel longitudinally, said reinforcement elements comprising two types of cables:

a plurality of rigid cables, formed of a first metal having an ultimate tensile strength of at least 500 MPa; and a plurality of elastic cables, formed of a second metal that is different from said first metal and that has a percentage elongation of at least 40%.

2. The transparent panel of claim 1, wherein said rigid cables are separate and spaced apart from said elastic cables.

3. The transparent panel of claim 1, wherein said rigid cables are intertwined with said elastic cables.

4. The transparent panel of claim 1, wherein said reinforcement elements are spaced apart at a distance of between 1 cm to 15 cm.

5. The transparent panel of claim 1, wherein the cross-sectional width of said reinforcement elements is between 1 mm to 5 mm.

6. The transparent panel of claim 1, wherein said rigid cables are composed of a metal selected from the list consisting of:

steel;
stainless steel;
hardened steel;
galvanized steel;
iron;
a metal alloy;
a treated metal; and
any combination of the above.

7. The transparent panel of claim 1, wherein said elastic cables are composed of a metal selected from the list consisting of:

stainless steel;
steel;
galvanized steel;
copper;
brass;
aluminum;
bronze;
iron;
a metal alloy;
a treated metal; and
any combination of the above.

8. The transparent panel of claim 2, wherein said elastic cables are interspersed with said rigid cables within said panel such that individual ones of said elastic cables alternate with individual ones of said rigid cables.

9. The transparent panel of claim 1, wherein said reinforcement elements extend in an alignment selected from the list consisting of:

horizontally;
vertically;
diagonally; and
a grid pattern.

10. The transparent panel of claim 1, wherein said reinforcement elements extend across the entire length of said panel.

11. The transparent panel of claim 1, wherein said reinforcement elements extend across the entire width of said panel.

12. The transparent panel of claim 1, wherein the thickness of said panel is between 2 mm to 150 mm.

13. The transparent panel of claim 1, wherein the transmittance of said panel is up to 92%.

14. The transparent panel of claim 1, wherein a surface of said panel is colored, and wherein the transmittance of said panel is above 6%.

15. An acoustic barrier comprising at least one transparent panel of acrylic glass as claimed in claim 1.

16. The use of a transparent panel of acrylic glass as claimed in claim 1 as an acoustic barrier.

17. A method for manufacturing a transparent panel of acrylic glass comprising internal reinforcement elements for securing fragments of said acrylic glass formed upon an impact with a foreign body, said method comprising the procedures of:

fabricating an acrylic glass sheet;

embedding a plurality of reinforcement elements interspersed within said sheet and spaced apart in parallel longitudinally, said reinforcement elements comprising two types of cables:

rigid cables, formed of a first metal having an ultimate tensile strength of at least 500 MPa, and elastic cables, formed of a second metal that is different from said first metal and that has a percentage elongation of at least 40%.

18. The method of claim 17, wherein said rigid cables are separate and spaced apart from said elastic cables.

19. The method of claim 17, wherein said rigid cables are intertwined with said elastic cables.

20. The method of claim 17, wherein said procedure of fabricating is implemented using a casting process.

* * * * *